United States Patent [19]

Marchesi

[11] Patent Number: 4,546,717

[45] Date of Patent: Oct. 15, 1985

[54] SEWING MACHINE DIFFERENTIAL FEED

[75] Inventor: Franco Marchesi, Pavia, Italy

[73] Assignee: Rockwell-Rimoldi S.p.A., Italy

[21] Appl. No.: 643,573

[22] Filed: Aug. 23, 1984

[30] Foreign Application Priority Data

Feb. 28, 1984 [IT] Italy ..... 19824 A/84

[51] Int. Cl.[4] ..... D05B 27/08

[52] U.S. Cl. ..... 112/313

[58] Field of Search ..... 112/313

[56] References Cited

U.S. PATENT DOCUMENTS 3,611,817 10/1971 Smith ..... 112/313
4,027,609 6/1977 Kerr ..... 112/313
4,469,039 9/1984 Marchesi ..... 112/313

FOREIGN PATENT DOCUMENTS 849795 9/1960 United Kingdom ..... 112/313

*Primary Examiner*—Werner H. Schroeder

*Assistant Examiner*—Andrew M. Falik

[57] ABSTRACT

Device for feeding the work in a differential-feed sewing machine, comprising a feed shaft (14) oscillating about its axis, a curved lever (32) connected on the one side to the said shaft (14) and on the other side to a small connecting rod (30) which is in turn hinged with the differential feed slide (27) and an element (38) for adjusting the feed in order to vary the amplitude of oscillation of the said small connecting rod (30), wherein there are provided means (34, 36) for locking and releasing the said lever (32) with respect to the feed shaft (14) and wherein the element (38) for adjusting the feed is free at one end (38') and at the other end is articulated with a pin (31) with which the said lever (32) and the said small connecting rod (30) are hinged so that the said lever (32), released from the shaft (14), is displaced by means of the said adjusting element (38), which makes it project more or less from the shaft (14), and is locked to the shaft (14) itself in the corresponding positions.

4 Claims, 3 Drawing Figures

SEWING MACHINE DIFFERENTIAL FEED

DESCRIPTION OF THE INVENTION

The present invention relates to a device for feeding the work in a sewing machine and in particular to the means for adjusting the degree of displacement of the differential feed slide.

Sewing machines with a differential feed device are known, in which the oscillating feed shaft is integral with a curved lever on which a sliding member is hinged with a small connecting rod which is in turn hinged with the said differential slide. Adjustment of the amplitude of oscillation of the said small connecting rod and hence of the differential feed is actuated by means of a lever which is also hinged with the said sliding member and can be fixed in positions corresponding to those which the sliding member is made to assume along the lever.

The above-mentioned embodiment basically has the two following defects:

1. The mass and hence the inertia of the oscillation lever with the sliding member is considerable even when the sliding member is located close to the axis of oscillation of the oscillating feed shaft, since a fairly large part of the lever projects from the said shaft. All of this leads to considerable wear and play in the entire system.

2. In fact, the sliding member has two oscillation axes consisting of the oscillating shaft of the lever on which the sliding member is located and the center of oscillation of the adjusting lever, as a result of which the sliding member will be continually subjected to alternating movements along the lever, giving rise to continual variations in the pattern of movement of the small connecting rod hinged with the differential slide and resulting in incorrect feed. Furthermore, the feed adjusting element is continually subjected to stresses until it eventually breaks.

Feed devices with the above-mentioned drawbacks are described for example in the U.S. Pat. Nos. 1,884,489 and 2,341,448.

The object and technical problem of the present invention have been precisely those of providing a feed device which does not have the above-mentioned defects, but which, rather, has the advantage that the system is lightened as a whole, that the hinging pin of the small connecting rod has only one center of oscillation and that the vertical loads on the feed adjusting element are zero.

This technical problem has been solved with the embodiment according to the claims of the present invention, which is described below and illustrated in the attached drawings in which:

Figure 1:
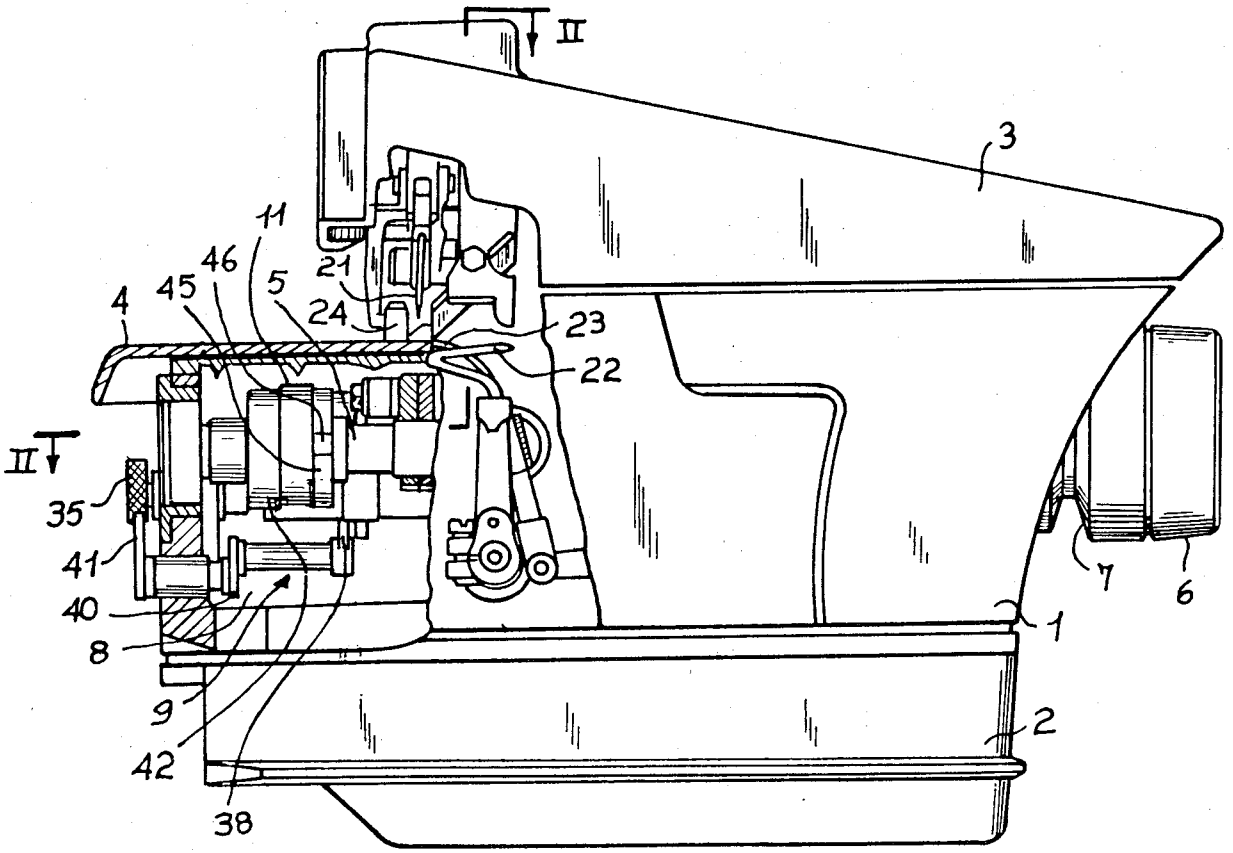
FIG. 1 represents the front view of a sewing machine comprising the device in question.
Figure 2:
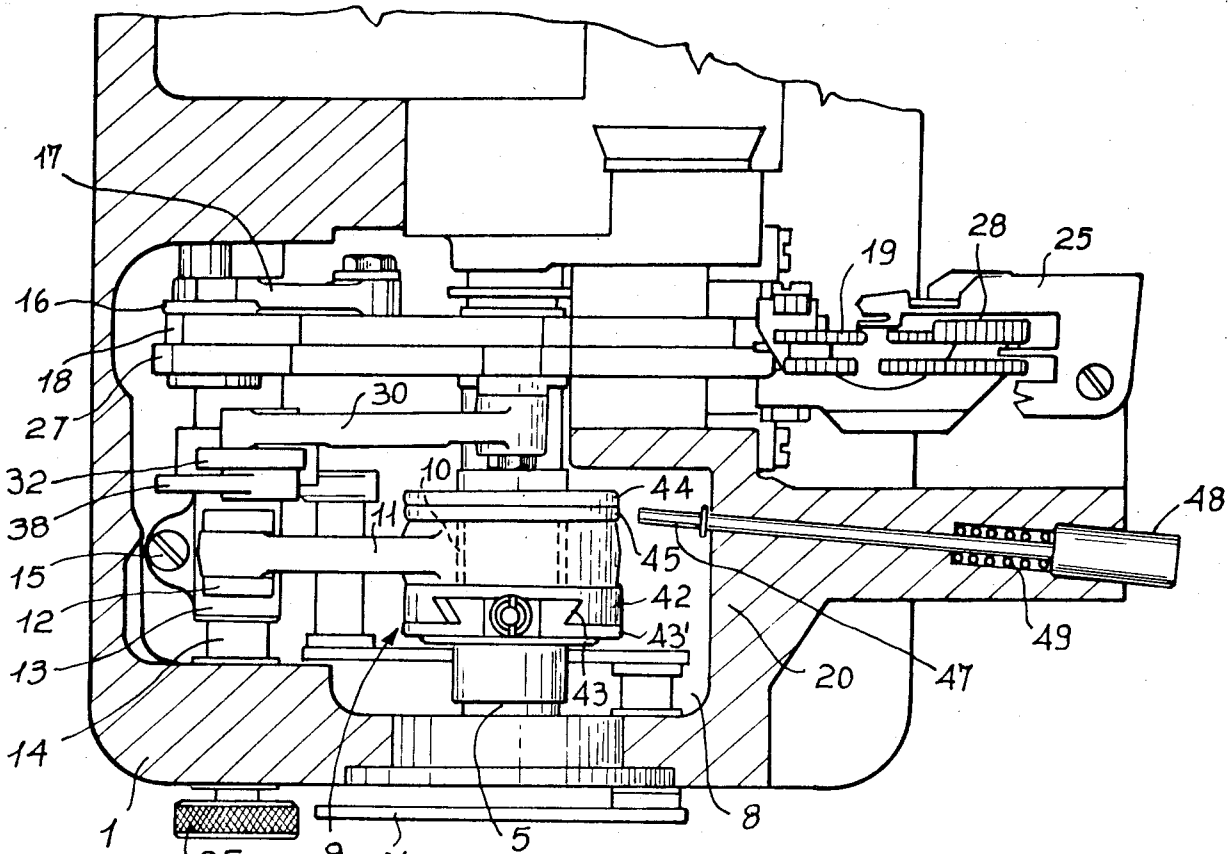
FIG. 2 is a horizontal section along the line II—11 of FIG. 1.
Figure 3:
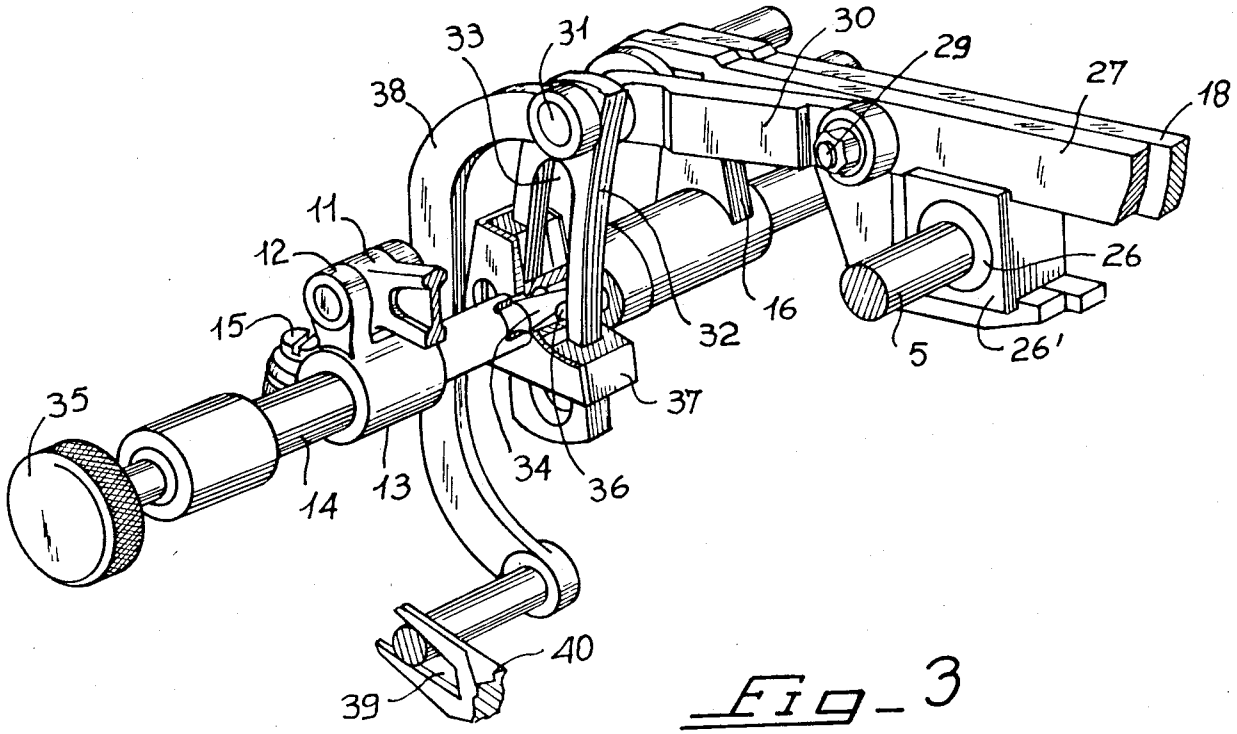
FIG. 3 is a perspective view of the device in question.

By way of example, the subject of the present invention has been illustrated as applied to an industrial sewing machine of the whipstitching type. With reference to FIG. 1, the machine generally consists of a housing comprising a base 1, a tank 2 for the lubricant, a mounting 3 arranged on the base 1 and a feed surface 4 for the work which must be stitched. The housing is hollow internally and appropriately supports inside all of those mechanisms required for operation of the machine. In particular, the main shaft 5 is supported rotatably inside the base 1 and has on its outside end a keyed handwheel 6 which is provided with a suitable grooved pully 7 designed to be connected to a normal actuating motor (not shown). The other end of the main shaft 5 is located in a chamber 8 where it supports the device 9 for feeding the work, comprising the elements described below: in a known manner, an actuating cam 10 rotated by means of the shaft 5 is provided with an oscillating connecting rod 11 (see also FIG. 2), which is articulated with an arm 12 integral with a sleeve 13 which embraces the oscilating feed shaft 14 and is fixed to it by means of the screw 15. The feed shaft 14 is also provided with another arm 16 which is similar to the preceding one and is connected via the small connecting rod 17 to the main jaw-carrying slide 18 on whose free end the main dog 19 is mounted. This dog is mounted in a zone outside the housing and separated from the chamber 8 by a dividing wall 20. A needle 21 is also operational in the external zone of the machine and cooperates with the usual lower stitching elements of the machine, which consist of the loopers 22 and 23. Above the feed surface 4 there is provided the usual presser foot 24 which cooperates with the dog 19 so as to feed the work during formation of the stitches. The known needle plate 25, on which the foot 24 presses, is provided between the external zone above the feed surface for the work and the lower zone where the jaw 19 operates.

The feed device 9 imparts to the main jaw-carrying slide 18 and to the respective jaw 19 a substantially horizontal movement which is combined with another substantially vertical movement generated by a cam 26 keyed onto the main shaft 5 and engaged in the sliding block 26' located underneath the slide 18. The two movements are orthogonal with respect to each other and, combining in a known manner, move the dog 19 first of all upwards until it projects beyond the needle plate 25 and then towards the rear of the machine so as to feed the stitched work; the dog 19 is then lowered beneath the needle plate and finally moved forwards again in order to repeat the feed cycle.

The sewing machine of the type mentioned has a differential feed and is therefore provided with a differential feed slide 27 which is located alongside the preceding main dog carrying slide 18 and carries the second dog 28 which is mounted so as to be aligned with the dog 19. The differential feed slide 27 is hinged at 29 with the small connecting rod 30 which is in turn hinged at 31 with the curved lever 32 coupled to the oscillating feed shaft 14 in a novel manner according to the present invention. The feed shaft 14 is inserted inside the groove 33 of the of the lever 32 and locked to it via locking means consisting of a push rod 34 which can be axially displaced within the hollow feed shaft 14 by means of the handle 35. The push rod 34 has a cone-shaped end by means of which some small spheres 36 are pushed towards the outside of the shaft 14 and, via appropriate holes bored radially in shaft 14, press against the walls of the groove 33 in the locked position of the push rod. The shaft 14 and lever 32 are released by moving the push rod 34 into the opposite position by means of the handle 35, so that the conical part of the said push rod no longer presses against the small spheres 36 since the latter are located in the region of a smaller diameter of the conical part. In this way the lever 32 can be displaced with its groove 33 perpendicularly to the shaft 14 and with its external part along the sliding guide 37 which is integral with the shaft 14. Thus, lever 32, once released from the shaft 14, is displaced by making it project more or less from the shaft 14 itself and is locked to the same in the various positions which correspond to movements of the small connecting rod 30 and differential slide 27 of varying amplitude.

Displacement of the lever 32 is actuated by the element 38 for adjusting the differential feed, one end of which is hinged with the small connecting rod 30 by means of the pin 31 and the other end 38' of which is engaged in the fork 39 of the lever 40 connected to the adjusting lever 41 which projects outside of the machine, near the handle 35.

The said block 26' supports both the slide 18 and the slide 27, so that raising of both the slides is actuated by means of the cam 26. In a known manner, the cam 10 is integral with the element 42 provided with a dovetail groove 43 coupled to a similar guide borne by the collar 43' in turn fixed to the shaft 5 which is also integral with the disk 44.

The ring 45 is mounted idle on the said shaft 5 and is provided with the radial groove 46 into which the end 47 of the button 48 can be inserted, if the latter is pressed against the return spring 49. When one wishes to vary the amplitude of oscillation of the connecting rod 11 and hence of the shaft 14, the button 48 is pressed until its end 47 is inserted inside the radial groove 46, so that, as a result of known elements, not described and illustrated here, upon rotation of the shaft 5 by means of the handwheel 6 of the sewing machine, the element 42 integral with the cam 10 moves along the groove 43 into positions which are eccentric with respect to the shaft 5. Each of these positions corresponds to a specific oscillation amplitude of the connecting rod 11 and hence of the small connecting rods 30 and 17 which supply the feed movements to the slides 27 and 18, respectively. With the above-described embodiment the following advantages are obtained:

1. The curved lever 32 projects from the feed shaft 14 only by the amount required for the corresponding displacement of the differential slide 27 and hence always with the least possible mass, thereby resulting in an overall lightening due to the elimination of the known slider.

2. The hinging pin 31 both for the small connecting rod 30 and for the adjusting element 38 oscillates about a single axis consisting of the oscillating feed shaft 14, with the result that the vertical loads on the said element 38 are zero.

A preferred embodiment of the present invention has been described above and hence the same can be modified and varied without, however, going outside the scope of the invention itself.

I claim:

1. Device for feeding the work in a differential-feed sewing machine, comprising a feed shaft oscillating about its axis, a curved lever connected on the one side to the said shaft and on the other side to a small connecting rod which is in turn hinged with the differential feed slide and an element for adjusting the feed in order to vary the amplitude of oscillation of the said small connecting rod, wherein there are provided means for locking and releasing the said lever with respect to the feed shaft and wherein the element for adjusting the feed is free at one end and at the other end is articulated with a pin with which the said lever and said small connecting rod are hinged so that the said lever, released from the shaft, is displaced by means of the said adjusting element, which makes it project more or less from the shaft, and can be locked to the shaft itself in the various positions.

2. Feed device as claimed in claim 1, wherein the said lever has a groove inside which the said shaft is inserted, the groove being made to slide perpendicularly with respect to the said shaft and being locked to it by means of the said locking means which can be inserted in between the shaft and the groove.

3. Feed device as claimed in claim 2, wherein the said locking and unlocking means consist of a push rod which can be axially displaced within the said shaft by means of a handle and which has a cone-shaped end against which one or more small spheres make contact and, via appropriate radial holes bored in the said shaft, press against the walls of the groove in the locked position of the push rod, whereas in the unlocked position the small spheres are located between the conical part of smaller diameter and the said holes without pressing against the walls of the groove.

4. Feed device as claimed in claim 2, wherein a sliding guide for the said lever is fixed to the said shaft.

* * * * *